United States Patent [19]

Mülfarth

[11] Patent Number: 4,630,783

[45] Date of Patent: Dec. 23, 1986

[54] MACHINE FOR WINDING A WEB OF PAPER ON A ROLL

[75] Inventor: Werner Mülfarth, Kirchheim, Fed. Rep. of Germany

[73] Assignee: Beloit Corporation, Beloit, Wis.

[21] Appl. No.: 747,297

[22] Filed: Jun. 21, 1985

[30] Foreign Application Priority Data

Jun. 29, 1984 [DE] Fed. Rep. of Germany ..... 3423987

[51] Int. Cl.[4] ..... B65H 19/26; B65H 19/28

[52] U.S. Cl. ..... 242/56 A

[58] Field of Search ..... 242/56 A, 56 R, 64

[56] References Cited

U.S. PATENT DOCUMENTS

| | | | |
|---|---|---|---|
| 3,794,256 | 2/1974 | Schwarz | 242/56 A |
| 4,327,876 | 5/1982 | Kuhn | 242/56 A |
| 4,541,583 | 9/1985 | Forman et al. | 242/56 A |

FOREIGN PATENT DOCUMENTS 2263264 3/1974 Fed. Rep. of Germany .

*Primary Examiner*—John M. Jillions

*Attorney, Agent, or Firm*—Hill, Van Santen, Steadman & Simpson

[57] ABSTRACT

A machine for winding webs of paper and the like onto a roll has a frame with a plurality of work stations, and a turret mounted for rotation in the frame and carrying a plurality of winding shafts supporting tubular cores arranged on a circle concentric with an axis of the turret which is movable in a stepwise manner to present separate winding shafts and cores at each of the stations. One of the stations is a winding and cutting station and includes a contact roller which extends parallel to the winding shaft at the station with a mounting arrangement for the contact roller enabling movement of the contact roller radially with respect to the roll being formed and also radially with respect to the turret to enable clearing the path of the next presented shaft and core. This movement in two different directions is accomplished by a double lever arrangement which is preferably controlled by a cam plate which is rotated in direct relationship to the rotation of the turret.

9 Claims, 8 Drawing Figures

MACHINE FOR WINDING A WEB OF PAPER ON A ROLL

BACKGROUND OF THE INVENTION

The present invention is directed to a device or machine for winding a web of paper or the like onto a roll core. The machine includes a frame having a plurality of work stations, a turret mounted for rotation on an axis in the frame and having a plurality of winding shafts for receiving tubular cores being mounted for rotation in the turret with the shafts being spaced around a circle concentric with the axis, an arrangement for rotating the turret in a step-like manner to move the shafts in a circular path from station-to-station with one of the work stations being a winding station where the web is wound on the core and then cut. At the winding station, the machine includes means for aiding the feeding of the web to the core which includes a contact roller over which the web passes as it is wound onto the core, and an arrangement for moving the contact roller approximately along the circle to press the web against the core as it is being wound thereon and for moving the contact roller radially to the circle and the turret to clear the path of the next shaft being moved into the winding station. When the winding of web on a core is about complete, the contact roller is moved radially to a retracted position as the turret is stepped to present an empty core to the winding station. At the same time, blade means are moved to cut the web with the newly cut web being entrained by the contact roller on the new core to begin the next winding operation.

Machines for winding webs on the rolls are known and an example is disclosed in German OS No. 22 63 264. Such machines are used for the purpose of packaging webs of paper, tissue, fleece, film material and the like by longitudinally cutting the web to a standard roll width and then rewinding them to a standard roll diameter. Given the known embodiment, a turret comprising four winding staffs distributed over a circle which is concentric with an axis is rotated in a frame to move the winding shafts successively past individual work stations. The lowermost work station of the stations is a winding station where the web is wound on a roll and then cut. When, as a result of the rotation of the turret, a new winding shaft with a fresh winding sleeve or core arrives at the winding station, a contact roller which is part of the feed arrangement is placed against the core on the winding shaft at a trailing side when looking at the flow of the web onto the core so that the web will go from the previous core and over the newly presented core. Then, the cutting blade of the blade means moves into the cutting position to cut a portion of the web that extends between the two cores and wrap the leading cut edge around the newly presented core so as to be entrained between the surface of the core and the web passing around the contact rollers to begin winding on the newly presented core. With this arrangement, there is no need to apply glue for starting the winding of the web onto a core. This type of web guidance during cutting and wrapping is a reason that the contact roller must press laterally against the core being formed and must be advanced up into the region of the circular path of the winding shafts when rotated by the turret.

The contact roller subsequently remains seated against the roll being formed, the latter being finished to a significant degree in the winding station. The contact of the contact roller thereby improves the winding quality. When the roll is near completion, the reel star or turret is rotated farther whereupon the nearly finished roll is moved into the next work station, namely, a finished winding and transfer station, where the winding is completed. Given this rotational advance of the turret the next winding shaft provided with a fresh winding sleeve or tubular core proceeds into the winding station.

In order for the newly presented shaft and core to pass the contact roller which is situated essentially in the circular path of the winding shaft approaching the winding station, the contact roller must be temporarily removed from the circular path. To this end, the contact roller is disposed on an inwardly extending carrier which is pivotally seated at a point beneath the winding station and the carrier can be pivoted away from the winding shaft situated at the winding station. This pivoting-out causes a motion component directly opposite to the movement created by moving the turret. The web is thereby entrained since it passes through a longitudinal cutting station disposed in a lower region of the carrier before it reaches the contact roller and then moves over the contact roller.

The motive or motion component, which is directly opposite the rotation of the turret or star reel, creates two disadvantages. The first disadvantage consists in that the free length of the product web is temporarily lengthened when the contact roller is pivoted away about the moving direction of the turret. This creates risk not only in view of the web running such as crease formation and the like but also leads to a temporary increase in the web tension which can cause the web to tear off given sensitive web material such as, for example, tissue or fleece. The second disadvantage is that when it is being pivoted away the contact roller first-near's the next winding shaft that is being rotated into the winding station so that either the next shaft must remain at a greater distance from the winding station until the contact roller has been pivoted completely away or the contact roller must be prematurely pivoted away in order to avoid collision with the next winding shaft that is being rotated into the station. As a consequence, the time during which the contact roller cannot press against the roll being formed is increased and this likewise causes undesirable results.

SUMMARY OF THE INVENTION

The object of the present invention is to improve the machine for winding rolls to such an extent that the described increase in the web tension and the contact-free times are greatly reduced.

This object is achieved on a machine for winding webs of paper and the like onto a roll core, said machine having a frame; a plurality of work stations mounted in the frame; a turret mounted for rotation on an axis in the frame, said turret having a plurality of winding shafts for receiving tubular cores on which the web is wound, said shafts being mounted for rotation in the turret with the shafts being spaced around a circle concentric with the axis; means for rotating the turret in a step-like manner to move the shafts in a circular path from station-to-station; and one of the work stations being a winding station having blade means for cutting a web and means for aiding the winding of the web onto the core, said blade means including a cutting edge extending parallel to the shaft and means for moving the cutting edge in a direction perpendicular to the edge from a retracted position to a cutting position, said means for aiding including a contact roller extending parallel to the shaft and positioning means for moving the roller approximately along the circle to press a web against the core on which it is being wound, said positioning means also moving the contact roller radially to the circle and turret to clear the circular path of the next shaft being moved into the one station so that as the winding of a roll means completion and the turret is rotated to present a new core and shaft at the station, the contact roll is moved radially out of the circular path to allow passage of the new core to the one station. Then the contact roller is moved back into a working position, which extends into the circular path and has the web extending from the roll over the new core to the contact roller, and the blade means is then moved to a cutting position to cut the web, to wrap the leading cut end around the new core and to entrain it between the web passing over the contact roller to begin winding of the web on the new core.

As a consequence of the radial motion of the contact roller, its opposition to the motion of the winding shaft being moved into the finished winding and transfer station with a nearly complete roll is substantially eliminated so that a potential increase in the tension on the web remains limited to unavoidable amounts attributed to the relatively slow rotation of the turret or reel star. In addition, since the contact roller no longer moves in a direction opposite to the movement of the winding shaft, the contact roller can be retained in place until the next shaft shortly reaches the contact roller at which time the roller is radially withdrawn from the circular path. The contact roller can thus remain in contact with the roll being formed for a longer period of time and until the last moment.

Preferably, the positioning means includes a first pair of levers having the contact roller mounted between one end each and the opposite end of the pair of levers being mounted for pivotal movement and for radial movement relative to the axis of the turret. Thus, the radial guidance of the contact roller is expediently insured by levers which are radially displaced relative to the turret. Preferably, a second pair of levers are pivoted to the first pair at the end opposite the contact rollers and in turn have their free ends mounted on a rotatable shaft which is mounted for rotation in the frame of the machine to form a double lever arrangement. The double lever enables the radial displacement and the simultaneously required displacement in a circumferential direction of the circular path of the turret which is required due to the necessity of following up the contact rollers given an increasing roll diameter in the winding station.

Preferably, the movement of the second pair of levers to move the first lever in a radial path and obliquely down is accomplished by a cam plate. The rotation of the cam plate is expediently coupled to the rotation for the turret so that the radial displacement is always initiated at the right timing sequence for the advancement of the turret.

It is recommended for design reasons to have the cam plate indirectly act on the second pair of levers by acting on a follower supported on an auxiliary lever which is secured to the shaft on which the second levers are mounted. This enables greater freedom in the positioning of the cam plate and levers in the frame. In order to pivot the first levers to move the contact roller along the circular path, a piston and cylinder unit is used and extends between the frame and the first pair of levers. This piston and cylinder unit enables a constant contact force to be established between the contact roller and the roll at the winding station.

BRIEF DESCRIPTION OF THE DRAWINGS

FIG. 4 showing continued forming of the roll at the winding station;

FIG. 5 illustrating moving the formed roll from the winding station towards the transfer station as a new roll core is moving into position at the winding station;

FIG. 6 illustrating cutting of the web and initiating the beginning of the web on the new roll at the winding station;

FIG. 7 showing the beginning of winding the web on the newly positioned roll and FIG. 8 being similar to FIG. 3.

DESCRIPTION OF THE PREFERRED EMBODIMENTS

Figure 1:
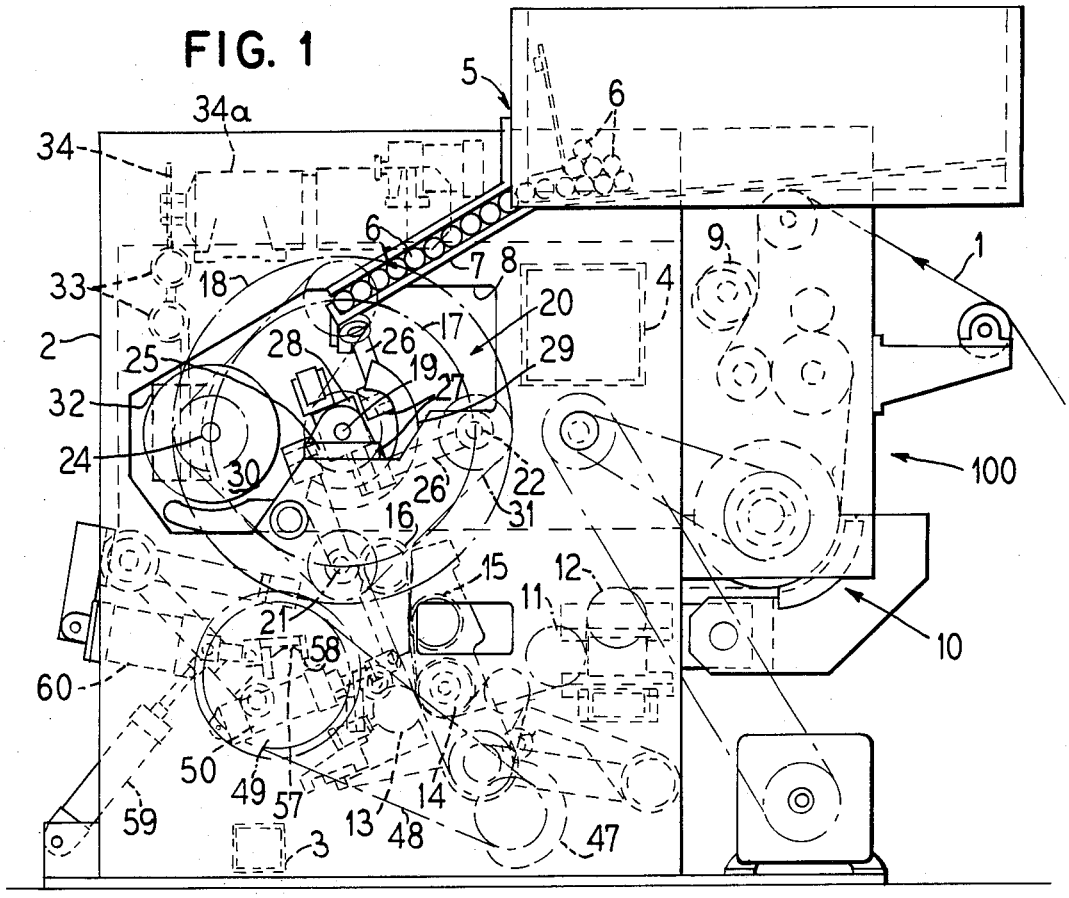
FIG. 1 is a side view of a machine in accordance with the present invention.

The principles of the present invention are particularly useful when incorporated in a machine generally indicated at 100 for winding a web of material 1 such as paper, tissue, fleece, film and the like onto a winding sleeve or tubular core 6.

The machine 100 has a machine frame which, in a standard fashion, is composed of two vertical side panels lying opposite one another at both sides of the web 1 with a front panel 2 being illustrated. The front panel 2 is connected to the back panel by cross-grids or braces 3 and 4 to form a stable frame and unit.

Delivery means 5 for cardboard winding sleeves or tubular cores 6 is mounted on an outer surface of the panel 2 to be laterally outside of the machine 100. The delivery means 5 has a magazine 7 which receives the cores 6 from a hopper and positions them for telescopic insertion onto a winding shaft of a turret or reel star 20 at a tube loading station of the machine 100. Suitable means are provided for moving the cores 6 perpendicular to the plane of the paper, through an opening 8 in the side panel 2 and onto the shaft.

In a haul-off means (not illustrated) which is disposed at the right of the machine 100 as viewed in FIG. 1, the web 1 is unwound from a mother roll and passes into the machine 100. As illustrated, the web 1 passes over a broad drawing drum 9 through a perforating station 10, over a pair of guide rollers 11 and 12 for measuring tension, through a longitudinal cutting station with a top cutter 13 and a bottom cutting blade 15. After passing the cutting station, the cut web or webs pass over a contact roller 16, which is seated to urge the webs against a winding shaft situated in a lower work station or, respectively, against a roll being formed thereon.

The turret or star reel 20 on one end which is the far end illustrated in FIG. 1 has a dish-shaped member 18 which supports one end of four winding shafts 21, 22, 23 and 24 which are arranged on a circle 17 with a uniform distribution over the circumference thereof. The turret 20 also includes a shaft 19 which is mounted by a bearing block such as 25 on the side panel 2 in the edge of the opening 8 and which shaft 19 forms an axis for the turret and extends parallel to the shafts 21–24. Each of the free ends of the shafts 21–24 are received in a separate bearing block which is on an arm 26 which is pivotally mounted in a trunnion 27 of a bearing support 28 on the shaft 19. The bearing blocks and arms 26 are normally held by a curved guide plate 29 in a plane perpendicular to the axis in the shaft 19 so that they will support the free ends of the winding shafts 21, 22, 23 and 24. The arms 26 are forwardly hinged out of the plane of the drawing only at the left and upper work stations so that a winding core 6 can be slipped onto the winding shaft in the upper station and so that a finished roll 30 can be removed or slipped off of the shaft 24 at the discharge station. Each of the winding shafts 21, 22, 23 and 24 is drivable on the turret 20 by torque-controllable coupling elements which are driven adjacent the disk 18 by a common drive belt 31.

The ejection of a finished roll 30 in the transfer or discharge station which is also the finish-winding station occurs by means of an ejector 32 which is displaceable along parallel guides 33 which are arranged one above the other and extending across or between the panels. The displacement of the ejector 32 is caused by a chain drive 34 with a motor 34*a*. The ejector 32 engages behind the rolls 30 in order to push them along the winding shaft 24 and out the opening 8 in the panel 2.

Figure 2:
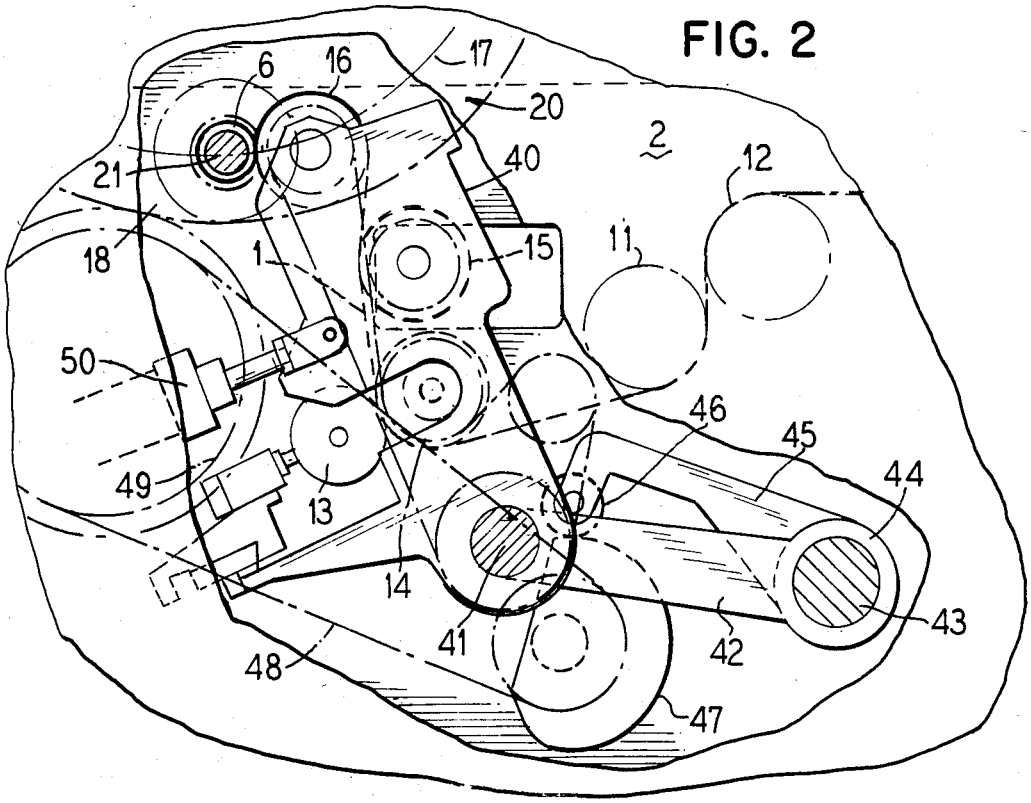
FIG. 2 is a partial side view of the lower central region of the machine of FIG. 1 with portions removed for purposes of illustration showing the essential elements of the invention.

The contact roller 16 is mounted for rotation at a free end of a lever arrangement having a first pair of levers 40 which extend roughly radially relative to the turret 20. The levers 40 are best illustrated in FIG. 2. In addition to mounting the contact roller 16 the levers 40 also mount a broad drawing drum 15 and the longitudinal cutting station with the top cutter 13 and the bottom blade 14. Thus, a web 1 moves from the bottom to the top of the levers 40 and is constantly wrapped around the contact roller 16 and onto a roll in the position of the shaft 21.

The pair of levers 40 at a lower end are connected together by a shaft 41. In addition, the shaft 41 forms a pivotal connection for a pair of second levers 42 whose other or second end is rigidly mounted to a hollow shaft 44, which is mounted for rotation in the frame of the machine and forms a bearing point 43. An auxiliary lever 45 is also torsionally connectêd to the hollow or tubular shaft 44. The auxiliary lever 45 extends essentially in the same direction as the second levers 42 from the hollow shaft 44 and has a follower or roll 46 at a free end which rests on a cam plate 47 that is mounted in the machine frame. The cam plate 47 is driven by a drive wheel 49 for the turret 20 via a chain 48. Thus, during a segment of rotation for the turret, the lever 45, the second lever 42 and the lever 44 will be lowered so that the contact roller 16 is moved downward out of the circular path 17 for the winding shafts 21, 22, 23 and 24.

The lever 40 is also pivoted around the point of articulation of the shaft 41. The pivoting is controlled by a piston and cylinder unit 50 which enables moving the roll 16 along the path 17 as the roll on the shaft 21 increases in diameter. It should be noted that the piston and cylinder unit 50 enable maintaining a controllable contact pressure between the contact roll 16 and the roll being formed on the shaft 21.

To understand the operation of the double lever arrangement of the levers 40 and 42 as well as the movement of the contact roller 16, reference is directed to FIGS. 3–8 which schematically show various operations of the device.

Figure 3:
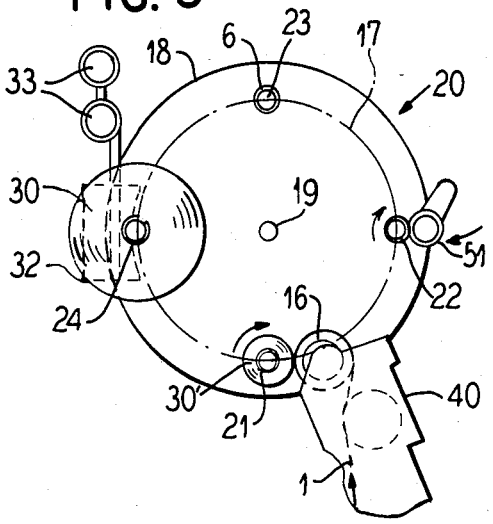
FIGS. 3–8 schematically show the various work phases or cycles of the turret and a contact roller during winding of a roll with FIG. 3 showing forming a roll at the winding station as a previously formed roll is being transferred from the turret.

In FIG. 3, a roll 30 on a shaft 24 is in the finished winding and cutting station and has been completed. An ejector 32 will be moved in a direction perpendicular to the plane of the Figure to eject the finished rolls from the machine. A new winding sleeve or core 6 has just been slipped onto the winding shaft 23 which is situated at the upper work station. At a right work station, the winding shaft 22 has the winding sleeve or core thereon pinched off to the dressed widths of the rolls to be produced with the pinching-off being accomplished by a sleeve pincher 51 so that the individual rolls can be easily separated. At the lower work station which is a winding station, the contact roller 16 is seated against a new roll 30′ which is being formed. It is noted that the contact roller 16 engages the new roll 30′ to the right of the shaft 21 or between the shaft 21 and the shaft 22 which is in the right side station.

Figure 4:
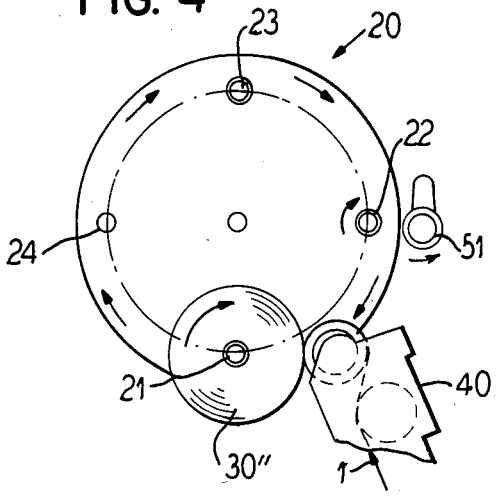
Figure 5:
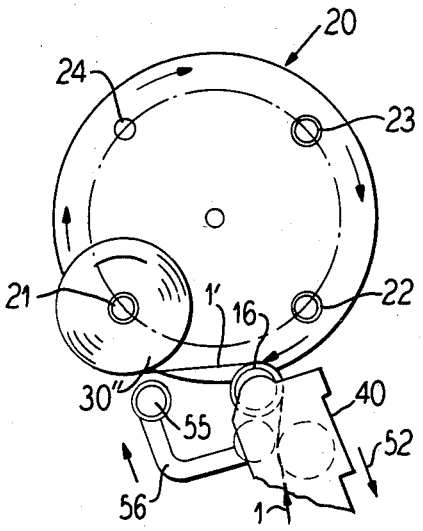

In FIG. 4, the finished roll 30 has been removed from the shaft 24. In addition, a roll 30″ on the shaft 21 is nearing completion. The sleeve pinchers 51 are pivoted away from the pinching position and the turret 20 begins to move in a specific clockwise direction. The winding of the roll 30″ is thereby continued. Shortly before the winding shaft 22 reaches the position of the contact roller 16, the arms or levers 40 are moved obliquely downward in the direction of arrow 52 (see FIG. 5). This movement of the arms 40 is radially relative to the turret 20 and is caused by the motion of the cam plate 47 whereby the contact roller 16 will be moved clear of the path for the winding shaft 22 as it is moved into the lowermost station which is the winding station. This movement is illustrated in FIG. 5. Given the rotation of the turret 20, the contact roller 16 is no longer seated against the roll 30″ but a free path length 1′ of the web will occur between the roll 30″ and roller 16. When the winding shaft 22 has reached the lower work station, the levers 40 with the contact roller 16 are then pushed upward in the direction of arrow 53 (FIG. 6) and also moved in the direction of arrow 54 to be placed against the winding shaft 22 or, respectively, the winding core situated thereon with a pfescribed force which is controlled by the piston and cylinder unit 50.

Figure 6:
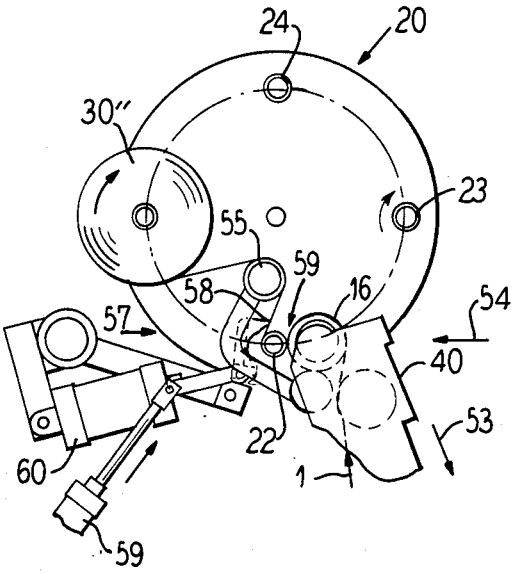
Figure 7:
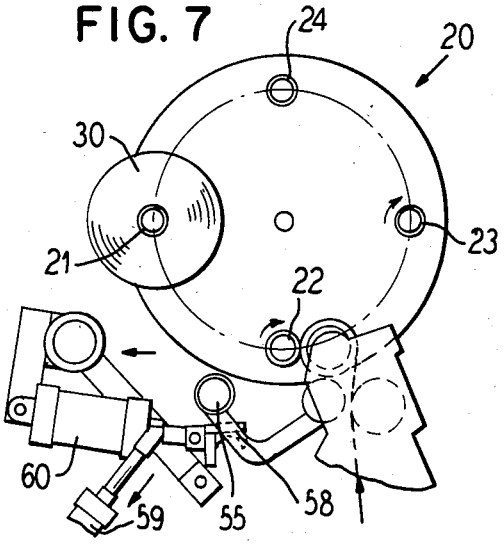

An enveloping roller 55, which is only shown in FIGS. 5, and 7, is mounted on angle levers 56 which are pivotally mounted on the first levers 40. By pivoting the angle levers 56 in a clockwise direction, the enveloping roller 55 will move into the free length 1′ of the web path as illustrated in FIG. 6. When in the position illustrated in FIG. 6 and when the contact roll 16 is in the upper position of FIG. 6, the web is wrapped around the core on the shaft 22 by more than 180°. A semicylindrical trough or member 57 is nestled against the winding sleeve situated on the shaft 22. As illustrated, the semicylindrical member 57 is moved towards the shaft 22 from the left by piston and cylinder units 59 and 60. On a front upper edge of the member 57 a serrated blade 58 is provided and is introduced to the portion of the web extending between the shaft 22 and the enveloping roller 55. The web is then severed and simultaneously a leading cut end is introduced into a nip 59 between the contact roll 16 and the core on the shaft 22 by the half shell 57 so that the leading end is entrained onto the core. It is noted that the application of glue is not necessary. In the meantime, the other cut end of the web is wound onto the roll 30" to complete the winding of that roll.

With the web cut, the roll on the shaft 21 is completed to form the complete roll 30, the enveloping roller 55 as well as the blade 58 are pivoted back to the retracted positions as illustrated in FIG. 7. The web 1 is wrapped on the core which is rotated with the shaft 22 to begin a new roll.

Figure 8:
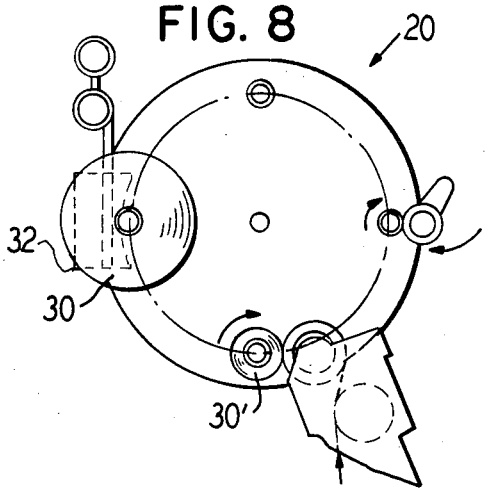

As illustrated in FIG. 8, the cycle is completed and started over with forming another roll 30' just as in the arrangement of FIG. 3. In addition, the ejector 32 is moving the roll 30 from the ejection station and a core in the rightmost station is being acted on by the pincher roll 51.

As a result of supporting the contact roller on a double lever arrangement, which comprises the levers 40, 42, the contact roller achieves the retention of the pivotability necessary for adapting to the changing winding diameters. The radial guidance of the contact roller 16 allows the free length 1' of the web guidance to be kept as short as possible and allows the tensile stresses appearing when the contact roller 16 is displaced out of the circular path of the winding shafts to be as low as possible. Namely, the tension is the value derived due to removal of the roll 30" from the contact roller 16 which will occur as a consequence of the rotation of the turret 20. As may be seen from FIG. 5, the winding shaft 22 can approach close to the contact roller 16 before the motion in the direction of the arrow 52 to withdraw the roller begins. Thus, desirable contact pressure on the web while being rolled on the roll will be continued for a longer period with the desired results.

Although various minor modifications may be suggested by those versed in the art, it should be understood that I wish to embody within the scope of the patent granted hereon, all such modifications as reasonably and properly come within the scope of my contribution to the art.

I claim:

1. A machine for winding webs of paper and the like onto a roll core, said machine comprising a frame; a plurality of work stations mounted in the frame; a turret mounted for rotation on an axis in said frame, said turret having a plurality of winding shafts, which receive tubular cores on which the web is wound, being mounted for rotation in the turret with the shafts being spaced around a circle concentric with the axis; means for rotating the turret in a step-like manner to move the shafts from station-to-station; and one of the work stations being a winding station having blade means for cutting a web and means for aiding the winding of the web onto a core at that station, said blade means including a cutting edge extending parallel to the shaft and means for moving the edge in a direction perpendicular to the edge from a retracted position to a cutting position, said means for aiding including a contact roller extending parallel to the shaft and positioning means for moving the roller approximately along the circle to press a web against the core on which it is being wound, said positioning means also moving the contact roller radially to the circle and the turret to clear the circular path of the next shaft being moved into the winding station so that as the winding of a roll on the shaft at the winding station nears completion, the contact roller is moved radially out of the path of a newly presented shaft and core and coacts with the blade means to cut the web and entrain the leading cut end of the web onto the newly presented core to begin winding.

2. A machine according to claim 1, wherein the position means for moving includes a lever arrangement having a first pair of levers, said contact roller being mounted at the end of the pair of first levers.

3. A machine according to claim 2, wherein the positioning means includes a second pair of levers having one end pivotally connected to the first pair of levers at an end of the first pair of levers opposite the contact roller and a second end being pivotally mounted in a fixed position in the frame so that pivotal movement of the second pair of levers shifts the first pair of levers in a radial direction and said first pair of levers can pivot relative to the second pair of levers.

4. A machine according to claim 3, wherein the positioning means includes a cam plate controlling the pivotal movement of the second pair of levers.

5. A machine according to claim 4, wherein said cam plate is coupled to the drive for the rotation of the turret.

6. A machine according to claim 5, wherein the positioning means includes an auxiliary lever having a follower engaging the cam plate, said auxiliary lever being secured to a shaft which is secured to the second end of said second pair of levers.

7. A machine according to claim 4, wherein the second end of the second pair of levers are mounted on a tubular shaft which is mounted for rotation in the frame, said positioning means includes an auxiliary lever secured to said tubular shaft and having a follower engaging the cam plate.

8. A machine according to claim 3, wherein the positioning means includes a piston and cylinder unit acting between the first pair of levers and the frame to pivot the first pair of levers relative to the one end of the second pair of levers.

9. A machine according to claim 1, wherein the winding station is the lowermost station in the machine, and said positioning means moves the contact roller obliquely downwardly from said winding station.

* * * * *